United States Patent [19]

Ina et al.

[11] 4,407,681

[45] Oct. 4, 1983

[54] HIGH TENSILE STEEL AND PROCESS FOR PRODUCING THE SAME

[75] Inventors: Katutoshi Ina; Kazuo Yamamoto; Hirokichi Higashiyama; Norio Ishikawa; Hiroshi Miyoshi, all of Kitakyushu, Japan

[73] Assignee: Nippon Steel Corporation, Tokyo, Japan

[21] Appl. No.: 387,264

[22] Filed: Jun. 9, 1982

Related U.S. Application Data

[63] Continuation of Ser. No. 158,135, Jun. 10, 1980, abandoned.

[30] Foreign Application Priority Data

Jun. 29, 1979 [JP] Japan ..... 54-81472
Aug. 8, 1979 [JP] Japan ..... 54-101020

[51] Int. Cl.[3] ..... C21D 8/00

[52] U.S. Cl. ..... 148/12 F; 75/123 K; 75/126 H; 148/12.4; 148/36

[58] Field of Search ..... 148/12 F, 12.3, 12.4, 148/36; 75/126 H, 123 K, 128 B

[56] References Cited

U.S. PATENT DOCUMENTS

| | | | |
|---|---|---|---|
| 2,147,122 | 2/1939 | Emmons | 75/126 C |
| 3,068,095 | 12/1962 | Anthony et al. | 75/126 H |
| 3,615,370 | 10/1971 | Ridal et al. | 75/128 B |
| 3,711,340 | 1/1973 | Korchynsky et al. | 148/36 |
| 4,137,104 | 1/1979 | Nashiwa et al. | 148/36 |
| 4,226,645 | 10/1980 | Waid et al. | 148/12.4 |

FOREIGN PATENT DOCUMENTS

| | | | |
|---|---|---|---|
| 21349 | 1/1981 | European Pat. Off. | 75/123 K |
| 48-34020 | 5/1973 | Japan | 75/123 K |
| 50-13732 | 5/1975 | Japan | 75/123 K |
| 50-98418 | 8/1975 | Japan | 75/123 K |
| 404565 | 1/1934 | United Kingdom | 75/126 H |
| 734676 | 8/1955 | United Kingdom | 75/126 H |

OTHER PUBLICATIONS

Greer, "Factors Affecting the Sulfide Stress Cracking Performance of High Strength Steels", *Materials Performance,* Mar. 1975, pp. 11–22.

*Primary Examiner*—Peter K. Skiff
*Attorney, Agent, or Firm*—Wenderoth, Lind & Ponack

[57] ABSTRACT

A high tensile steel which has a satisfactory yield strength of 60 kg/mm$^2$ or more and excellent resistances to sulfide corrosive cracking and corrosion, and which comprises, as indispensable components, 0.05 to 0.50 wt % of C, 0.1 to 1.0 wt % of Si, 0.1 to 2.0 wt % of Mn, 0.05 to 1.50 wt % of Co and the balance consisting of Fe, is produced by hot- or cold-rolling it, rapidly heating the rolled steel to austenitize it, quenching the austenitized steel and, finally, tempering the quenched steel at a temperature not higher than the $Ac_1$ point of the steel.

11 Claims, 7 Drawing Figures

(COMPARISON EXAMPLE 1)

(EXAMPLE 1)

(EXAMPLE 3)

(EXAMPLE 4)

HIGH TENSILE STEEL AND PROCESS FOR PRODUCING THE SAME

This is a continuation application of Ser. No. 158,135 filed June 10, 1980, abandoned.

FIELD OF THE INVENTION

The present invention relate to a high tensile steel and a process for producing the same. More particularly, the present invention relates to a high tensile steel having excellent resistances to sulfide-corrosive cracking and corrosion in an environmental atmosphere containing sulfides, especially, hydrogen sulfide ($H_2S$).

BACKGROUND OF THE INVENTION

In the excavation, transportation and storage of oil, it is frequently found that various pipes, machines and tanks made of steel are corroded and corrosion-embrittled by sulfides, especially, hydrogen sulfide ($H_2S$) contained in oil. Also, welded portions of tanks for storing liquidized propane gas (LPG) are frequently corrosion-embrittled by sulfides, especially, hydrogen sulfide.

Recently, the steel material used to produce the above-mentioned pipes and tanks is required to have an increased mechanical strength. However, it is known that the increase in the mechanical strength of the steel material causes the resistance of the steel material to sulfide-corrosion cracking to be deteriorated. Also, hydrogen sulfide is highly corrosive to such steel material. Therefore, when the pipes or tanks are kept in contact with oil or LPG containing hydrogen sulfide for a long period of time, the pipes and tanks are corroded so that the thicknesses of the peripheral walls of the pipes and tanks are decreased. The reduced thickness of the walls of the pipes and tanks causes them to exhibit a poor mechanical strength so that they cannot satisfactorily effect their functions.

In the past, many attempts were made to resolve the above-mentioned problem. However, none of the attempts were successful in providing a high tensile low alloyed steel having excellent resistances to both sulfide corrosion cracking and corrosion.

Generally, it has been believed that, in order to provide a certain level of resistance to sulfide corrosion cracking, the mechanical strength of the steel material should be limited to a certain range. That is, it has been considered that a lower limit of the resistance of the steel material to sulfide corrosion cracking can be set by determining an upper limit of the mechanical strength of the steel material.

Also, it has been believed that, in order to increase the resistance of the steel material to sulfide corrosion cracking, satisfactory quenching and tempering procedures should be applied to the steel material so that the steel material has a tempered martensite structure.

The above-mentioned beliefs are accepted in API Standard, 5AC, relating to pipes for oil-wells. That is, the Standard stipulates an upper limit in the hardness of the steel material, and states that quenching and tempering operations should be applied to the steel material. Also, the Standard stipulates the lower limit in the tempering temperature to be applied to the steel material. However, even if a steel material is produced in accordance with the Standard, the resultant steel material usually exhibits an unsatisfactory resistance to sulfide corrosion cracking.

For the purpose of protecting the low alloyed steel material from corrosion, usually, the steel material is coated with a corrosion-resistant paint or protected by means of a cathodic protection or by applying a corrosion-inhibitor to the corrosive environment. However, substantially no attempts have been made to increase the resistance of the steel material itself to the corrosion.

SUMMARY OF THE INVENTION

An object of the present invention is to provide a high tensile steel having a high yield strength of 60 kg/mm$^2$ or more and exhibiting excellent resistances to sulfide corrosion cracking and corrosion, and a process for producing the same.

The above-mentioned object can be attained by the high tensile steel of the present invention, which has excellent resistances to sulfide corrosion cracking and corrosion, and which comprises, as indispensable components, 0.05 to 0.50% by weight of carbon, 0.1 to 1.0% by weight of silicon, 0.1 to 2.0% by weight of manganese, 0.05 to 1.50% by weight of cobalt and the balance consisting of iron, and inevitable impurities, and which has been quenched and tempered, and has a yield strength of 60 kg/mm$^2$ or more.

The high tensile steel of the present invention may contain, as an additional component, at least one member selected from the group consisting of 0.10 to 0.50% by weight of copper, 0.2 to 2.0% by weight of chromium, 0.05 to 1.0% by weight of molybdenum, 0.05 to 1.0% by weight of tangsten, 0.01 to 0.15% by weight of niobium, 0.01 to 0.15% by weight of vanadium, 0.01 to 0.15% by weight of titanium and 0.0003 to 0.0050% by weight of boron.

Also, the high tensile steel of the present invention may contain, as a further additional component, at least one member selected from the group consisting of 0.001 to 0.010% by weight of calcium, 0.001 to 0.050% by weight of lanthanum and 0.001 to 0.050% by weight of cerium.

The high tensile steel of the present invention can be produced by a process which comprises the steps of:

hot- or cold- rolling a steel comprising, as indispensable components, 0.05 to 0.5% by weight of carbon, 0.1 to 1.0% by weight of silicon, 0.1 to 2.0% by weight of manganese, 0.05 to 1.50% by weight of cobalt and the balance consisting of iron, and inevitable impurities;

rapidly heating the rolled steel to austenitize it;

quenching the austenitized steel by using water or oil, and;

tempering the quenched steel at a temperature not higher than $Ac_1$ point of the steel.

DETAILED DESCRIPTION OF THE INVENTION

Figure 1:
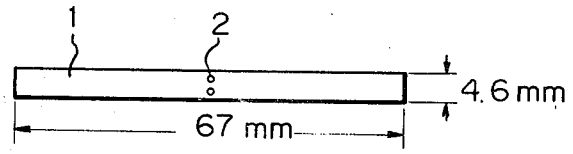
FIG. 1 is a plane view of a specimen for testing resistances of a steel to sulfide corrosion cracking and corrosion.

The high tensile steel of the present invention, which has been quenched and tempered, and has a yield strength of 60 kg/mm$^2$ or more, preferably, 65 kg/mm$^2$ or more, contains, as indispensable components:

0.05 to 0.50% by weight, preferably, from 0.10 to 0.35% by weight, of carbon;

0.1 to 1.0% by weight of silicon;

0.1 to 2.0% by weight of manganese, and;

0.05 to 1.5% by weight, preferably, from 0.05 to 1.0% by weight, of cobalt,

Carbon contained in the steel of the present invention should be in a content of 0.05% by weight or more in order to enhance the hardenability of the steel. However, in order to avoid an undesirable decrease in toughness and an undesirable increase in sensitivity to quenching cracks during a heat treatment, it is necessary that the content of carbon be 0.50% by weight or less.

In consideration of the desired resistance to the sulfide corrosion cracking and desirable strength of the steel, it is preferable that the amount of carbons be in a range of from 0.10 to 0.35% by weight.

In order to obtain a steel material having no defect by satisfactorily deoxidizing the steel during a steel-making process, it is necessary that the amount of silicon contained in the steel be 0.1% by weight or more. However, an excessively large content of silicon causes the workability of the steel to be deteriorated. Therefore, the amount of silicon should be limited to 1.0% by weight or less.

Manganese is effective for enhancing the hardenability property of the steel and increasing the strength and toughness of the steel when used in an amount of 0.1% by weight or more. When the amount of manganese is less than 0.1% by weight, the above-mentioned enhancing and increasing effects cannot be expected. However, an excessively large content of manganese in the steel results in a deteriorated workability of the resultant steel. Therefore, the content of manganese in the steel should be not more than 2.0% by weight.

Cobalt is remarkably effective for enhancing the resistances of the steel to sulfide corrosion cracking and corrosion when used in a content of 0.05% by weight or more. A content of cobalt of less than 0.05% by weight is not effective for the above-mentioned enhancement. However, this enhancement in the resistances to sulfide corrosion cracking and corrosion is maximized by the content of cobalt of 1.5% by weight. Therefore, from the view point of economy, it is not preferable that the content of cobalt in the steel be more than 1.5% by weight. In the range of from 0.05 to 1.5% by weight, the larger the content of cobalt, the higher the resistances of the steel to sulfide corrosion cracking and corrosion. However, in consideration of economy, it is preferable that the content of cobalt in the steel be in a range of from 0.05 to 1.0% by weight.

High tensile steel may contain an additional component consisting of at least one member selected from the group consisting of:

0.10 to 0.50% by weight, preferably, 0.10 to 0.35% by weight, of copper;

0.20 to 2.0% by weight of chromium;

0.05 to 1.0% by weight of molybdenum;

0.05 to 1.0% by weight of tungsten;

0.01 to 0.15% by weight, preferably, 0.01 to 0.10% by weight, of niobium;

0.01 to 0.15% by weight, preferably, 0.01 to 0.10% by weight of vanadium;

0.01 to 0.15% by weight, preferably, 0.01 to 0.10% by weight, of titanium, and;

0.0003 to 0.0050% by weight, preferably, 0.0003 to 0.003% by weight of boron.

It is believed that in a corrosive environment having a pH of 4.5 or more, sulfide corrosion cracking of the steel is mainly derived from penetration of hydrogen into the steel. Copper is effective for preventing the penetration of hydrogen into the steel. When the content of copper in the steel is less than 0.1%, the effect of preventing the penetration of hydrogen is unsatisfactory. Also, when the content of copper is more than 0.5% by weight, the resultant steel exhibits a poor workability. Usually, it is preferable that the content of copper in the steel be in a range of from 0.1 to 0.35% by weight.

Chromium is effective for increasing the resistance of the steel to corrosion and enhancing the quenching property and the strength of the steel. However, the above-mentioned effects are not satisfactory if the content of chromium is less than 0.2% by weight. Also, an excessively large content of chromium causes the resultant steel to exhibit an increased brittleness, and a deteriorated hot-workability and welding property. Therefore, the content of chromium in the steel should be 2.0% by weight or less.

Titanium is effective for fixing free nitrogen in the steel and promoting the effect of boron in enhancing the quenching property of the steel. Usually, when a steel is produced in an ordinary melting furnace, the resultant steel contains nitrogen in an amount of from 0.003 to 0.01%. Therefore, in order to completely fix the above-mentioned amount of nitrogen, it is necessary that the content of titanium in the steel be at least 0.01% by weight. Also, a content of titanium of more than 0.15% by weight will cause the resultant steel to be embrittled. Accordingly, it is necessary that the content of titanium in the steel be in a range of from 0.01 to 0.15% by weight.

Boron is effective for enhancing the hardenability of the steel even when the content of boron is very small. However, the content of boron in the steel should be in a range of from 0.0003 to 0.005% by weight, because a content of boron of less than 0.0003% by weight is not sufficient for attaining the above-mentioned effect on the steel and a content of boron of more than 0.005% by weight result in a deteriorated hardenability hot-workability and toughness of the resultant steel.

Niobium and vanadium, each in a content of from 0.01 to 0.15% by weight, and molybdenum and tungsten, each in a content of from 0.05 to 1.0% by weight, are effective for imparting a proper hardenability and a necessary strength to a steel product having a desired thickness. When the content of each of the above-mentioned metals is lower than the corresponding lower limit stated above, the above-mentioned effect on the resultant steel is unsatisfactory. Also, a content of each metal higher than the corresponding upper limit stated above causes the resultant steel to exhibit an enhanced brittleness and deteriorated hot-workability, machinability and weldability.

The high tensile steel of the present invention may contain further additional component consisting of at least one member selected from the group consisting of:

0.001 to 0.010% by weight of calcium;
0.001 to 0.050% by weight of lanthanum, and;
0.001 to 0.050% by weight of cerium.

Calcium, lanthanum and cerium are effective for spheroidizing sulfide-type inclusion in the steel so as to improve anisotropy in the mechanical property of the steel, and also, for preventing cracking of the steel due to the sulfide corrosion. However, a content of each of the above-mentioned metals lower than the corresponding lower limit thereof causes the above-mentioned effect on the resultant steel to be unsatisfactory. Also, a content of each metal higher than the corresponding upper limit thereof results in a deterioration in cleanness of the resultant steel.

The high tensile steel of the present invention has a yield strength of 60 kg/mm$^2$ or more, preferably, 65 kg/mm$^2$ or more. Due to the fact that the depth of an oil well increases with years of use, it is required to enhance the strength of the steel pipes for oil wells. The American Petroleum Institute's Standard, API-5A, N-80 requires that steel pipes for oil wells have a yield strength of from 56 to 77 kg/mm$^2$. Conventional steel pipes having the above-mentioned yield strength usually exhibit an unsatisfactory resistance to sulfide corrosion cracking. However, the high tensile steel of the present invention has not only a satisfactory yield strength, but also, an excellent resistance to sulfide corrosion cracking.

The high tensile steel of the present invention can be produced in a process in which a steel comprising at least the afore-mentioned indispensable components is hot- or cold-rolled, rapidly heated to a temperature at which the steel is austenitized, quenched by using water or oil and, finally, tempered at a temperature not higher than the $Ac_1$ point of the steel. Usually, the steel is produced in a convertor or electric furnace and the melted steel is continuously casted or poured to provide a steel ingot. The steel ingot is bloomed and the bloom is hot-rolled to convert it to a pipe, plate or bar, or the steel is cold-rolled.

The hot- or cold-rolled steel is rapidly heated to a temperature at which the steel is austenitized. That is, it is preferable that the temperature of the steel reach a level of from 850° to 950° C. during the heating procedure.

It is preferable that the rapid heating procedure be carried out at a heating rate of 2° C./sec or more. This rapid heating procedure can be effected by using any heating method. However, it is preferable that the heating procedure be carried out by using an induction heating method.

The austenitized steel is preferably subjected to a quenching procedure within ten minutes after the steel reaches the austenitizing temperature thereof. That is, it is preferable that the austenite structure of the steel be maintained only for a short time of 10 minutes or less. The quenching procedure for the austenitized steel is carried out by using water or quenching oil. The quenching temperature is preferably in a range of from 800° to 950° C. This quenching procedure usually causes the quenched steel to have at least a 90% martensite structure.

The tempering procedure for the quenched steel is carried out at a temperature not higher than the $Ac_1$ point of the steel. However, it is preferable that the tempering temperature be from 500° to 720° C. This procedure can be effected by any heating method.

The combination of the above-specified composition of the steel with the above-specified quenching and tempering procedure is important to import not only an excellent yield strength of 60 Kg/mm$^2$ or more, but also, excellent resistances to sulfide corrosion cracking and corrosion to the high tensile steel of the present invention.

In the process of the present invention, it is important that the cobalt-containing steel be rapidly heated for the austenitization. This feature is effective for enhancing the resistances of the steel to sulfide corrosion cracking and corrosion. That is, the effect of cobalt on enhancing the above-mentioned resistances of the steel is remarkable when the steel has a tempered martensite structure. However, this effect is very slight when the steel has a ferrite pearlite structure which has been produced by a rolling or a normalizing procedure applied to the steel.

It has not yet been completely clarified why cobalt can enhance the resistances of the high tensile steel to sulfide corrosion cracking and corrosion. However, it is assumed that a layer containing cobalt in an enriched content is formed on the peripheral surface of the steel product, and serves as a protecting layer for the steel product from the corrosive action of the wet environment containing hydrogen sulfide. Also, it is assumed that the cobalt-enriched layer serves as a layer which prevents penetration of hydrogen, which has been produced by the corrosion of the steel with hydrogen sulfide, into the inside of the steel product. Furthermore, it is assumed that the cobalt improves the composition and distribution of carbides distributed in a matrix in the tempered martensite structure of the steel, which increases the resistance of the steel to the initiation and propagation of sulfide corrosion cracks.

As mentioned above, in the process of the present invention, the heating procedure for the austenitization is rapidly carried out, preferably, at a heating rate of more than 2° C./sec and by using an induction heating method. This feature results in a very fine grain structure of the austenitized steel. This fine grain structure is maintained even after the austenitized steel is martensitized and, therefore, serves to enhance the resistances of the steel to sulfide corrosion cracking and corrosion.

Generally, it is believed that the enhancement of the resistance of the steel to sulfide corrosion cracking can be attained by satisfactorily tempering the steel so as to form stable carbides therein. Also, it is generally recognized that the tempering procedure by using an induction heating method is not proper for attaining the above-mentioned enhancement, because this induction tempering procedure is carried out rapidly within such a short time that the formation of the stable carbides is not satisfactory.

However, cobalt added to the steel serves to increase the diffusing rate of carbon in the steel during the tempering procedure and, therefore, to promote the formation of the carbides. Consequently, even when the cobalt-containing steel is tempered by using the induction heating method, the resultant tempered steel can exhibit an excellent resistance to sulfide corrosion cracking.

The following specific examples are presented for the purpose of clarifying the present invention. However, it should be understood that these are intended only to be examples of the present invention and are not intended to limit the present invention in any way.

In the examples, a resistance of a steel to sulfide corrosion cracking was determined by the following testing method.

Referring to FIG. 1, a testing specimen 1 of a steel had a length of 67 mm, a width of 4.6 mm, and a thickness of 1.5 mm. The specimen 1 had two holes 2 (stress raisers) having a diameter of 0.7 mm and located in the center of the specimen 1.

Figure 2:
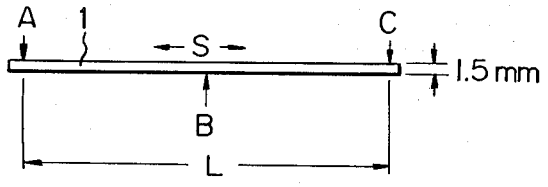
FIG. 2 is a front view of the specimen indicated in FIG. 1, for explaining a testing method on a resistance of the steel to sulfide corrosion cracking.

Referring to FIG. 2, the specimen 1 was supported at a center point B thereof and bent downward by applying a load to each of points A and C located in the ends of the specimen 1, so as to produce a stress S at the center point B of the specimen 1. The intensity of the stress S was calculated in accordance with the following equation.

$$S = \frac{6Et}{L^2} \cdot \delta$$

wherein L represents a length between the points A and C in the specimen 1, E represents a Young's modulus of the specimen 1, t represents a thickness of the specimen 1 and δ represents a strain at the center point B.

Under the above-mentioned loaded condition, the specimen was immersed in an aqueous solution containing 0.5% of acetic acid, 5% of sodium chloride and 3000 ppm of hydrogen sulfide, and having a pH of 3.0 to 3.5, at a temperature of 25° C., for 14 days. A critical stress Sc under which cracks were produced on the specimen due to sulfide corrosion thereof, was determined for the specimen. Also, an average corroding rate of the specimen per $cm^2$ of the peripheral surface area of the specimen per day was determined.

EXAMPLES 1 THROUGH 8 AND COMPARISON EXAMPLES 1 THROUGH 6

In each of the Examples 1 through 8 and Comparison Examples 1 through 6, a steel pipe which had been hot rolled and had a composition indicated in Table 1 was heated to 900° C. at a heating rate of 30° C./min by using an electric furnace. After the temperature of the steel was maintained at the level of 900° C. for 30 minutes, the steel was quenched at a quenching temperature indicated in Table 1 by using water as a quenching medium. The quenched steel had a more than 90% martensite structure. The quenched steel was tempered at a tempering temperature indicated in Table 1 by using an electric furnace.

The yield strength (YS), tensile strength (TS) and critical stress (Sc), and the average corrosion amount of the resultant steel are indicated in Table 1.

TABLE 1

| Example No. | Composition (% by weight) of Steel | | | | | | | | | | | | | | |
|---|---|---|---|---|---|---|---|---|---|---|---|---|---|---|---|
| | C | Si | Mn | P | S | Cu | Cr | Co | Mo | W | V | Nb | Ti | B | Al |
| 1 | 0.19 | 0.25 | 0.45 | 0.012 | 0.005 | — | 0.98 | 0.10 | — | — | — | — | — | — | 0.021 |
| 2 | 0.20 | 0.25 | 1.47 | 0.005 | 0.005 | — | — | 0.35 | — | — | — | — | — | — | 0.068 |
| 3 | 0.19 | 0.23 | 0.46 | 0.010 | 0.006 | — | 0.99 | 0.50 | — | — | — | — | — | — | 0.032 |
| 4 | 0.18 | 0.25 | 0.46 | 0.014 | 0.005 | 0.26 | 0.98 | 0.91 | — | — | — | — | 0.020 | 0.0018 | 0.082 |
| 5 | 0.20 | 0.27 | 0.82 | 0.006 | 0.012 | — | — | 0.50 | 0.21 | — | — | — | — | — | 0.019 |
| 6 | 0.15 | 0.21 | 1.21 | 0.010 | 0.010 | — | — | 0.50 | — | 0.42 | — | — | — | — | 0.025 |
| 7 | 0.27 | 0.28 | 1.19 | 0.014 | 0.013 | — | — | 0.50 | — | — | 0.06 | — | 0.019 | 0.0020 | 0.023 |
| 8 | 0.20 | 0.24 | 1.25 | 0.012 | 0.011 | — | — | 0.50 | — | — | — | 0.03 | 0.023 | 0.0025 | 0.020 |
| Comparison Example | | | | | | | | | | | | | | | |
| 1 | 0.19 | 0.25 | 0.46 | 0.015 | 0.010 | — | 0.98 | — | — | — | — | — | — | — | 0.023 |
| 2 | 0.34 | 0.23 | 1.26 | 0.016 | 0.005 | — | 0.12 | — | — | — | — | — | — | — | 0.042 |
| 3 | 0.24 | 0.32 | 1.06 | 0.011 | 0.012 | — | — | — | 0.21 | — | 0.06 | — | 0.031 | 0.0015 | 0.003 |
| 4 | 0.21 | 0.24 | 1.55 | 0.004 | 0.003 | — | — | — | 0.10 | — | — | — | — | — | 0.030 |
| 5 | 0.27 | 0.25 | 1.31 | 0.005 | 0.003 | 0.26 | 0.98 | — | — | — | — | — | — | — | 0.021 |
| 6 | 0.35 | 0.25 | 1.20 | 0.016 | 0.015 | — | — | — | — | — | — | — | — | — | 0.053 |

| Example No. | Quenching temperature (°C.) | Tempering temperature (°C.) | YS ($kg/mm^2$) | TS ($kg/mm^2$) | Sc ($kg/mm^2$) | Average corroding rate ($mg/cm^2/day$) |
|---|---|---|---|---|---|---|
| 1 | 900 | 670 | 62.1 | 73.1 | 122 | 2.0 |
| | | 610 | 71.0 | 78.2 | 108 | |
| | | 540 | 79.5 | 86.7 | 86 | |
| 2 | 900 | 550 | 74.4 | 83.4 | 102 | 1.1 |
| 3 | 900 | 670 | 61.0 | 71.9 | 136 | 0.8 |
| | | 610 | 69.9 | 78.5 | 122 | |
| | | 550 | 79.2 | 86.5 | 102 | |
| 4 | 900 | 670 | 62.4 | 72.5 | 136 | 0.7 |
| | | 610 | 69.9 | 77.4 | 128 | |
| | | 550 | 76.8 | 83.8 | 117 | |
| 5 | 900 | 560 | 81.0 | 87.1 | 100 | 0.8 |
| 6 | 900 | 555 | 79.2 | 85.5 | 105 | 0.8 |
| 7 | 900 | 630 | 75.3 | 83.1 | 106 | 0.9 |
| 8 | 900 | 590 | 76.4 | 85.0 | 108 | 0.8 |
| Comparison Example | | | | | | |
| 1 | 900 | 670 | 61.2 | 71.8 | 79 | 4.6 |
| | | 610 | 71.0 | 79.5 | 66 | |
| | | 540 | 79.5 | 85.4 | 37 | |
| 2 | 900 | 620 | 77.8 | 84.3 | 50 | 4.1 |
| 3 | 900 | 615 | 80.5 | 86.9 | 30 | 3.8 |
| 4 | 900 | 600 | 75.4 | 82.1 | 45 | 3.9 |
| 5 | 900 | 665 | 74.3 | 83.6 | 45 | 4.6 |
| 6 | — | — | 32.0 | 60.1 | >140 | 4.8 |

Table 1 clearly indicates that the steel produced in each of Examples 1 through 8 exhibited not only a satisfactory yield strength and tensile strength, but also, excellent resistances to sulfide corrosive cracking and corrosion. However, in the conventional steel of Comparison Example 1, the resistance to sulfide corrosive cracking remarkably decreased with increases in the yield strength thereof. Also, the steels of Comparison Examples 1 through 5 which contained no cobalt, exhibited poor resistances to sulfide corrosion cracking and corrosion, while the yield strength of the steels were satisfactory. The steel of Comparison Example 6, which contained no cobalt, exhibited an excellent resistance to sulfide corrosive cracking. However, this steel also exhibited a very poor yield strength and resistance to corrosion.

Figure 3:
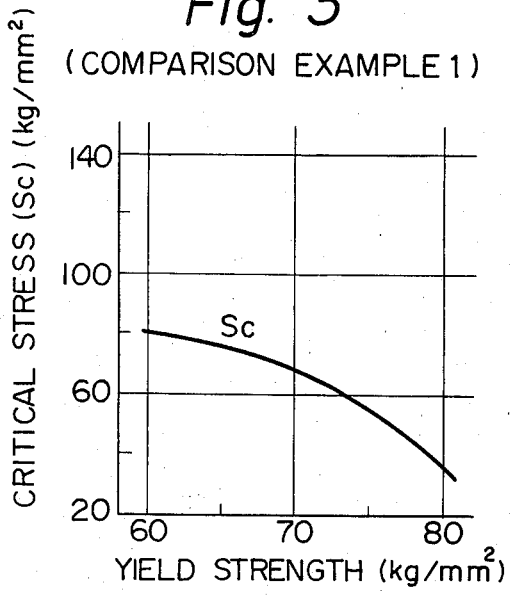
FIGS. 3 through 6 are respectively a graph showing a relationship between the yield strength of a steel and the critical stress (Sc) thereof.

Referring to FIG. 3 when the yield point of the steel of Comparison Example 1, containing no cobalt, is changed from about 60 to about 80 Kg/mm$^2$, the critical stress Sc remarkable decreases from about 80 to 36 Kg/mm$^2$.

Figure 4:
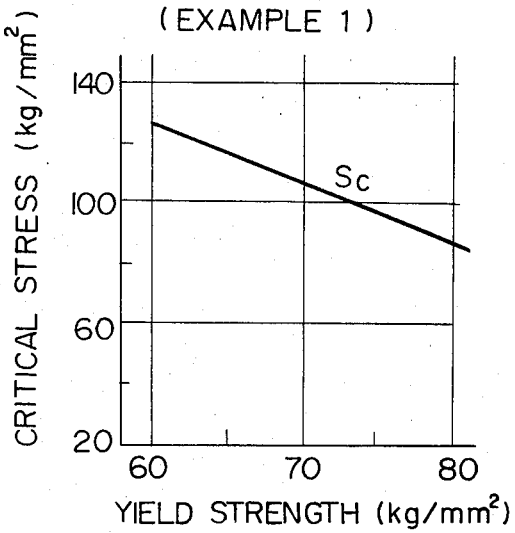

However, referring to FIG. 4, a change in the yield point of the steel of Example 1, containing 0.10% of cobalt, from about 60 to about 80 Kg/mm$^2$ causes the critical stress Sc of the steel to change from 122 to 86 Kg/mm$^2$ which are in a satisfactory high level.

Figure 5:
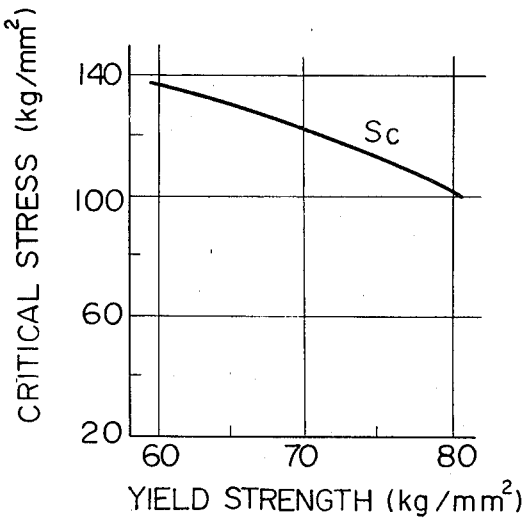

Also, referring to FIG. 5, a change in the yield point of the steel of Example 3, containing 0.50% of cobalt, from about 60 to about 80 Kg/mm$^2$ causes the critical stress Sc of the steel to change from 136 to 102 Kg/mm$^2$ which are in a satisfactory high level.

Figure 6:
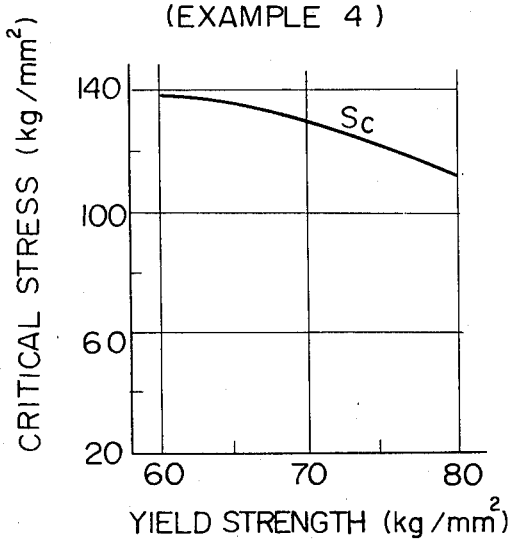

Furthermore, referring to FIG. 6, a change in the yield strength of the steel of Example 4, containing 0.91% of cobalt, from about 60 to about 80 Kg/mm$^2$ causes the critical stress Sc of the steel to change from 136 to 117 kg/mm$^2$ which are in a satisfactory high level.

Figure 7:
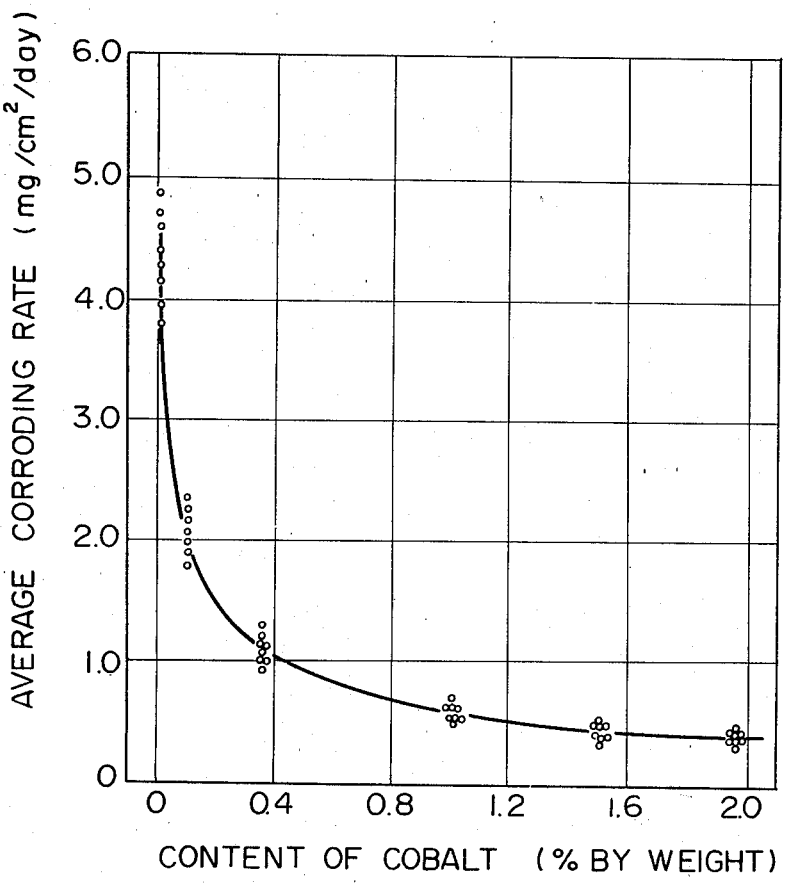
FIG. 7 is a graph showing a relationship between contents of cobalt in various steels and the average corrosion amounts of the steels.

Referring to FIG. 7, showing a relationship between content of cobalt in a steel and the average corroding rate of a steel in the above-mentioned aqueous solution containing hydrogen sulfide, it is clear that an increase in the content of cobalt in the steel from 0 to 1.5% by weight causes the average corroding rate of the steel to remarkably decrease.

EXAMPLES 9 THROUGH 14

In Example 9, a steel pipe which had been hot rolled, was heated to a temperature of 900° C. at a heating rate of 5° C./sec by an induction heating method at a frequency of 360 Hz. After the temperature of the steel was maintained at the level of 900° C. for 30 seconds, the steel was quenched at a quenching temperature indicated in Table 2 by using water as a quenching medium, and the tempering procedure was carried out at a temperature of 690° C. by using an induction heating method at a frequency of 360 Hz.

In Example 10, the same procedures as those mentioned in Example 1 were carried out, except that the tempering procedure was carried out at a temperature of 610° C. by using an electric furnace.

In Example 11, the same procedures as those mentioned in Example 9 were carried out, except that the tempering procedure was carried out at a temperature of 690° C. by using an induction heating method at a frequency of 360 Hz.

In Example 12, the same procedures as those mentioned in Example 1 were carried out, except that the tempering procedure was carried out at a temperature of 610° C. by using an electric furnace.

In Example 13, the same procedures as those mentioned in Example 9 were carried out, except that the tempering procedure was carried out at a temperature of 690° C. by using an induction heating method at a frequency of 360 Hz.

In Example 14, the same procedures as those mentioned in Example 1 were carried out, except that the tempering procedure was carried out at a temperature of 610° C. by using an electric furnace.

The properties of the resultant steels of Examples 9 through 14 are indicated in Table 2.

EXAMPLES 15 THROUGH 21

In each of the Examples 15 through 21, the same procedures as those mentioned in Example 9 were carried out, except that the steel has a composition indicated in Table 2, and the tempering temperature was as indicated in Table 2.

The properties of the resultant steels of Examples 15 through 21 are indicated in Table 2.

TABLE 2

| Example No. | Composition (% by weight) of Steel | | | | | | | | | | | | | | |
|---|---|---|---|---|---|---|---|---|---|---|---|---|---|---|---|
| | C | Si | Mn | P | S | Cu | Cr | Co | Mo | W | V | Nb | Ti | B | Al |
| 9 | 0.19 | 0.25 | 0.45 | 0.012 | 0.005 | — | 0.98 | 0.10 | — | — | — | — | — | — | 0.021 |
| 10 | 0.19 | 0.25 | 0.45 | 0.012 | 0.005 | — | 0.98 | 0.10 | — | — | — | — | — | — | 0.021 |
| 11 | 0.19 | 0.23 | 0.46 | 0.010 | 0.006 | — | 0.99 | 0.50 | — | — | — | — | — | — | 0.032 |
| 12 | 0.19 | 0.23 | 0.46 | 0.010 | 0.006 | — | 0.99 | 0.50 | — | — | — | — | — | — | 0.032 |
| 13 | 0.18 | 0.25 | 0.46 | 0.014 | 0.005 | 0.26 | 0.98 | 0.91 | — | — | — | — | 0.020 | 0.0018 | 0.082 |
| 14 | 0.18 | 0.25 | 0.46 | 0.014 | 0.005 | 0.26 | 0.98 | 0.91 | — | — | — | — | 0.020 | 0.0018 | 0.082 |
| 15 | 0.20 | 0.25 | 1.47 | 0.005 | 0.005 | — | — | 0.35 | — | — | — | — | — | — | 0.068 |
| 16 | 0.20 | 0.27 | 0.82 | 0.006 | 0.012 | — | — | 0.50 | 0.21 | — | — | — | — | — | 0.019 |
| 17 | 0.15 | 0.21 | 1.21 | 0.010 | 0.010 | — | — | 0.50 | — | 0.42 | — | — | — | — | 0.025 |
| 18 | 0.27 | 0.28 | 1.19 | 0.014 | 0.013 | — | — | 0.50 | — | — | 0.06 | — | 0.019 | 0.0020 | 0.023 |
| 19 | 0.20 | 0.24 | 1.25 | 0.012 | 0.011 | — | — | 0.50 | — | — | — | 0.03 | 0.023 | 0.0025 | 0.020 |
| 20 | 0.21 | 0.25 | 1.45 | 0.004 | 0.005 | — | — | 0.30 | — | — | — | Ca 0.0047 | 0.020 | 0.0015 | 0.030 |
| 21 | 0.20 | 0.24 | 1.43 | 0.006 | 0.006 | — | — | 0.31 | — | — | La 0.0061 | Ce 0.0082 | 0.019 | 0.0020 | 0.025 |

| Example No. | Quenching temperature (°C.) | Tempering temperature (°C.) | Heating method for tempering and quenching | YS (kg/mm$^2$) | TS (kg/mm$^2$) | Sc (kg/mm$^2$) | Average corroding rate (mg/cm$^2$/day) |
|---|---|---|---|---|---|---|---|
| 9 | 900 | 690 | Induction | 72.2 | 78.9 | 115 | 2.0 |
| 10 | 900 | 610 | Electric furnace | 71.0 | 78.2 | 108 | 2.0 |
| 11 | 900 | 690 | Induction # | 70.1 | 78.3 | 130 | 0.8 |
| 12 | 900 | 610 | Electric | 69.9 | 78.5 | 122 | 0.8 |

TABLE 2-continued

| | | | | | | | |
|---|---|---|---|---|---|---|---|
| | | | furnace # | | | | |
| 13 | 900 | 690 | Induction # | 70.2 | 77.3 | 135 | 0.7 |
| 14 | 900 | 610 | Electric furnace # | 69.9 | 77.4 | 128 | 0.7 |
| 15 | 900 | 650 | Induction | 73.8 | 81.4 | 122 | 1.2 |
| 16 | 900 | 660 | " | 79.6 | 85.0 | 120 | 0.8 |
| 17 | 900 | 650 | " | 79.0 | 85.0 | 119 | 0.7 |
| 18 | 900 | 710 | " | 74.8 | 81.9 | 118 | 0.9 |
| 19 | 900 | 680 | " | 75.2 | 83.1 | 121 | 0.8 |
| 20 | 900 | 650 | " | 73.5 | 81.2 | 128 | 1.1 |
| 21 | 900 | 650 | " | 74.2 | 81.7 | 125 | 1.3 |

We claim:

1. A high tensile steel having excellent resistance to sulfide corrosion cracking and corrosion which steel has substantially a martensite structure and a yield strength of 60 to 81 kg/mm$^2$ and which steel has been prepared by hot- or cold-rolling a steel consisting essentially of, as indispensable components, 0.05% to 0.50% by weight of carbon, 0.1% to 0.28% by weight of silicon, 0.1% to 2.0% by weight of manganese, 0.05% to 1.50% by weight of cobalt, and the balance consisting of iron and inevitable impurities; said high tensile steel being produced by rapidly heating said rolled steel to a temperature of from 850° C. to 950° C. at a heating rate of 2° C./ sec or more to austenitize it; then quenching said austenitized steel by using water or oil; and tempering said quenched steel at a temperature not higher than $Ac_1$ point of said steel.

2. A high tensile steel as claimed in claim 1, wherein said steel has a yield strength of 65 to 81 kg/mm$^2$.

3. A high tensile steel as claimed in claim 1, wherein said steel contains, as an additional component, at least one member selected from the group consisting of 0.10% to 0.50% by weight of copper, 0.2% to 0.99% by weight of chromium, 0.05% to 1.0% by weight of molybdenum, 0.05% to 1.0% by weight of tungsten, 0.01% to 0.15% by weight of niobium, 0.01% to 0.15% by weight of vanadium, 0.01% to 0.15% by weight of titanium, and 0.0003% to 0.0050% by weight of boron.

4. A high tensile steel as claimed in claim 1 or 3, wherein said steel contains, as further additional components, at least one member selected from the group consisting of 0.001% to 0.010% by weight of calcium, 0.001% to 0.050% by weight of lanthanum, and 0.001% to 0.050% by weight of cerium.

5. A process for producing a high tensile steel having substantially a martensite structure and a yield strength of 60 to 81 kg/mm$^2$ and exhibiting excellent resistance to sulfide corrosion cracking and corrosion, which comprises the steps of:

hot- or cold-rolling a steel consisting essentially of, as indispensable components, 0.05% to 0.50% by weight of carbon, 0.1% to 0.28% by weight of silicon, 0.1% to 2.0% by weight of manganese, 0.05% to 1.50% by weight of cobalt, and the balance consisting of iron and inevitable impurities;

rapidly heating said rolled steel to a temperature of from 850° C. to 950° C. at a heating rate of 2° C./ sec or more to austenitize it;

quenching said austenitized steel by using water or oil; and tempering said quenched steel at a temperature not higher than the $Ac_1$ point of said steel.

6. A process as claimed in claim 5, wherein said steel contains, as an additional component, at least one member selected from the group consisting of 0.10% to 0.50% by weight of copper, 0.2% to 0.99% by weight of chromium, 0.05% to 1.0% by weight of molybdenum, 0.05% to 1.0% by weight of tungsten, 0.01% to 0.15% by weight of niobium, 0.01% to 0.15% by weight of vanadium, 0.01% to 0.15% by weight of titanium, 0.0003% to 0.0050% by weight of boron, 0.001% to 0.010% by weight of calcium, 0.001% to 0.050% by weight of lanthanum, and 0.001% to 0.050% by weight of cerium.

7. A process as claimed in claim 5 or 6, wherein said heating procedure is carried out by using an induction heating method.

8. A process as claimed in claim 5 or 6, wherein after said heating procedure, said austenitized steel is subjected to said quenching procedure within 10 minutes.

9. A process as claimed in claim 5 or 6, wherein said quenched steel has at least a 90% martensite structure.

10. A process as claimed in claim 5 or 6, wherein said quenching procedure is carried out at a quenching temperature of from 800° C. to 950° C.

11. A process as claimed in claim 5 or 6, wherein said tempering procedure is carried out at a tempering temperature of from 500° C. to 720° C.

* * * * *